US008646285B2

(12) United States Patent
Choi et al.

(10) Patent No.: US 8,646,285 B2
(45) **Date of Patent: *Feb. 11, 2014**

(54) CONTROL APPARATUS FOR TAKING OUT ICE OF REFRIGERATOR AND METHOD THEREOF

(75) Inventors: Kyung-Ah Choi, Gyeongsangnam-Do (KR); Mi-Son Ahn, Gyeongsangnam-Do (KR); Chang-Woo Song, Gyeongsangnam-Do (KR); Young-Shin Park, Gyeongsangnam-Do (KR); Ki-Cheol Woo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 974 days.

This patent is subject to a terminal disclaimer.

(21) Appl. No.: 12/439,920

(22) PCT Filed: Sep. 4, 2007

(86) PCT No.: PCT/KR2007/004251

§ 371 (c)(1),
(2), (4) Date: Mar. 4, 2009

(87) PCT Pub. No.: WO2008/030023

PCT Pub. Date: Mar. 13, 2008

(65) Prior Publication Data

US 2010/0204832 A1 Aug. 12, 2010

(30) Foreign Application Priority Data

| | | |
|---|---|---|
| Sep. 4, 2006 | (KR) | 10-2006-0084695 |
| Sep. 20, 2006 | (KR) | 10-2006-0091336 |
| Sep. 20, 2006 | (KR) | 10-2006-0091337 |
| Sep. 28, 2006 | (KR) | 10-2006-0094792 |

(51) Int. Cl.
*F25C 1/00* (2006.01)
*F25C 5/18* (2006.01)

(52) U.S. Cl.
USPC ..... 62/137; 62/344; 222/146.6

(58) Field of Classification Search
USPC ..... 62/137, 344, 389, 390; 222/146.6, 222/144.5, 144.6, 52, 63, 1, 23
See application file for complete search history.

(56) References Cited

U.S. PATENT DOCUMENTS

| | | | |
|---|---|---|---|
| 3,441,176 | A | 4/1969 | Reynolds et al. |
| 3,635,043 | A | 1/1972 | Sterling |

(Continued)

FOREIGN PATENT DOCUMENTS

| | | | |
|---|---|---|---|
| CN | 1157882 | A | 8/1997 |
| CN | 2532434 | Y | 1/2003 |

(Continued)

OTHER PUBLICATIONS

Machine Translation of JP 2003-262438 Sep. 2003; 9 pages.*

(Continued)

*Primary Examiner* — Chen Wen Jiang
(74) *Attorney, Agent, or Firm* — Birch, Stewart, Kolasch & Birch, LLP

(57) ABSTRACT

The present invention relates to a control apparatus for taking out ice of a refrigerator and a method thereof. The present invention includes an input unit for inputting the amount of ice to be taken out; and a taking-out unit for taking out the ice corresponding to the amount inputted to the input unit.

19 Claims, 8 Drawing Sheets

(56) References Cited

U.S. PATENT DOCUMENTS

| | | | | |
|---|---|---|---|---|
| 4,822,996 | A | 4/1989 | Lind | |
| 5,033,273 | A | 7/1991 | Buchset et al. | |
| 5,050,777 | A | 9/1991 | Buchser | |
| 5,291,752 | A | 3/1994 | Alvarez et al. | |
| 5,429,269 | A | 7/1995 | Mejias | |
| 5,501,367 | A * | 3/1996 | Chigira | 222/55 |
| 5,671,606 | A | 9/1997 | Schroeder et al. | |
| 5,855,120 | A | 1/1999 | Kim | |
| 6,050,097 | A | 4/2000 | Nelson et al. | |
| 6,176,099 | B1 | 1/2001 | Hynes | |
| 6,314,745 | B1 | 11/2001 | Janke et al. | |
| 6,381,975 | B1 * | 5/2002 | Tsuchikawa | 62/233 |
| 6,439,428 | B1 * | 8/2002 | Schroeder et al. | 222/64 |
| 6,581,392 | B1 * | 6/2003 | Gist et al. | 62/66 |
| 7,201,005 | B2 * | 4/2007 | Voglewede et al. | 62/126 |
| 7,210,601 | B2 | 5/2007 | Hortin et al. | |
| 7,325,408 | B2 * | 2/2008 | Lim | 62/66 |
| 7,543,453 | B2 | 6/2009 | Boarman et al. | |
| 7,921,667 | B2 * | 4/2011 | Gradl et al. | 62/340 |
| 2003/0019236 | A1 | 1/2003 | Heims et al. | |
| 2003/0089120 | A1 | 5/2003 | Kampert et al. | |
| 2003/0110952 | A1 * | 6/2003 | Lassota | 99/279 |
| 2005/0044874 | A1 | 3/2005 | Lee et al. | |
| 2006/0196214 | A1 | 9/2006 | Lee et al. | |
| 2008/0228318 | A1 * | 9/2008 | Roo et al. | 700/231 |

FOREIGN PATENT DOCUMENTS

| | | | |
|---|---|---|---|
| CN | 100356122 | A | 4/2006 |
| EP | 1 607 700 | A2 | 12/2005 |
| GB | 2 188 724 | A | 10/1987 |
| JP | 06-137736 | A | 5/1994 |
| JP | 8-106575 | A | 4/1996 |
| JP | 11-513475 | A | 11/1999 |
| JP | 2000-130902 | A | 5/2000 |
| JP | 2003262438 | A * | 9/2003 |
| JP | 2005-225514 | A | 8/2005 |
| KR | 10-0162443 | B1 | 1/1999 |
| KR | 10-0201408 | B1 | 6/1999 |
| KR | 1999-0065602 | A | 8/1999 |
| KR | 2000-0034724 | A | 6/2000 |
| KR | 10-0332757 | B1 | 4/2002 |
| KR | 10-0408573 | B1 | 11/2003 |
| KR | 20-0338113 | Y1 | 12/2003 |
| KR | 20-0347071 | Y1 | 3/2004 |

OTHER PUBLICATIONS

English-language abstract of JP-2676316-B2 (Nov. 12, 1997).

* cited by examiner

CONTROL APPARATUS FOR TAKING OUT ICE OF REFRIGERATOR AND METHOD THEREOF

TECHNICAL FIELD

The present invention relates to a refrigerator, and more particularly, to a control apparatus for taking out ice made in a refrigerator and a method thereof.

BACKGROUND ART

Generally, a refrigerator has an ice maker disposed in a freezing chamber for making ice. And, the ice made in the ice maker is transferred to a dispenser disposed at a door of the freezing chamber, and then taken out according to selecting by a user.

However, a related art refrigerator has a problem that the user cannot check whether or not an ice storage box is filled with the ice, and to check this, the user should see the inside with the naked eye by opening a door of the refrigerator.

Further, the related art refrigerator has another problem that the refrigerator cannot stop making ice by sensing with a sensor when the ice storage box is filled with the ice, and make and store the ice as much as wanted by the user.

Further, the related art refrigerator has the other problem that the refrigerator cannot provide fresh ice with the user, which is caused by taking out the ice stored in the ice storage box for a long time, because the refrigerator has made too much ice more than needed and stored it.

Further, the related art refrigerator has the other problem that the ice is made until the ice storage box is filled with the ice, accordingly wasting power source.

Further, the related art refrigerator has the other problem that when pressing a button for taking out the ice, a certain amount of ice is taken out according to the time duration or times pushing the button, accordingly the user cannot take out the ice in an accurate number, rather more ice than needed.

DISCLOSURE OF THE INVENTION

Technical Problem

To achieve these and other advantages and in accordance with the purpose of the present invention, as embodied and broadly described herein, there is provided a control apparatus for taking out ice of a refrigerator which is capable of taking out ice corresponding to the amount inputted by a user, and a method thereof.

Another object of the present invention is to provide a control apparatus for taking out ice of a refrigerator which is capable of making and separating ice after receiving water, and then detecting the amount of the separated ice so that the detected amount is displayed, and a method thereof.

Still another object of the present invention is to provide a control apparatus for taking out ice of a refrigerator which is capable of displaying whether or not the ice is full for a user when an ice storing unit is filled with the separated ice, and a method thereof.

Technical Solution

To achieve these and other advantages and in accordance with an aspect of the present invention, there is provided a control apparatus for taking out ice of a refrigerator, the control apparatus comprising: an input unit for inputting the amount of ice to be taken out; and a taking-out unit for taking out the ice corresponding to the amount inputted to the input unit.

To achieve these and other advantages and in accordance with another aspect of the present invention, there is provided a control method for taking out ice of a refrigerator, the method comprising: inputting the amount of ice to be taken out; and taking out the ice corresponding to the inputted amount.

MODES FOR CARRYING OUT THE PREFERRED EMBODIMENTS

The preferred embodiments for a control apparatus for taking out ice of a refrigerator which is capable of taking out ice, based on the amount and/or time duration for taking out the ice, which is inputted by a user, and a method thereof, will be described in detail with reference to FIGS. 1 to 8.

Figure 1:
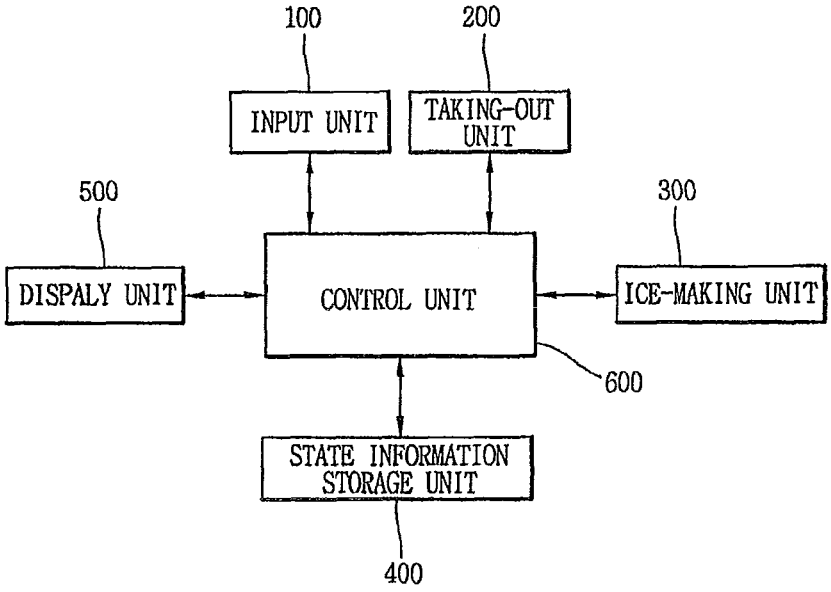
FIG. 1 is a block diagram showing a configuration of a control apparatus for taking out ice of a refrigerator in accordance with one embodiment of the present invention.

FIG. 1 is a block diagram showing a configuration of a control apparatus for taking out ice of a refrigerator which is capable of taking out ice, based on the amount and/or time duration for taking out the ice, which is inputted by a user.

As shown in FIG. 1, the control apparatus for taking out ice of the refrigerator includes an input unit 100 for inputting the amount and/or time duration for taking out the ice by a user; a taking-out unit 200 for taking out the ice based on the amount and/or time duration for taking out the ice, which is inputted to the input unit 100; an ice-making unit 300 for making and separating the ice after receiving water and for detecting the amount of the separated ice; a state information storage unit 400 for storing the amount and/or time duration for taking out the ice, which is inputted through the input unit 100, and the amount of ice detected through the ice-making unit 300, respectively, and a display unit 500 for displaying; and a control unit 600 for controlling an overall operation of the taking-out amount input unit 100, the taking-out unit 200, the ice-making unit 300, and the state information storage unit 400 and the display unit 500.

Figure 2:
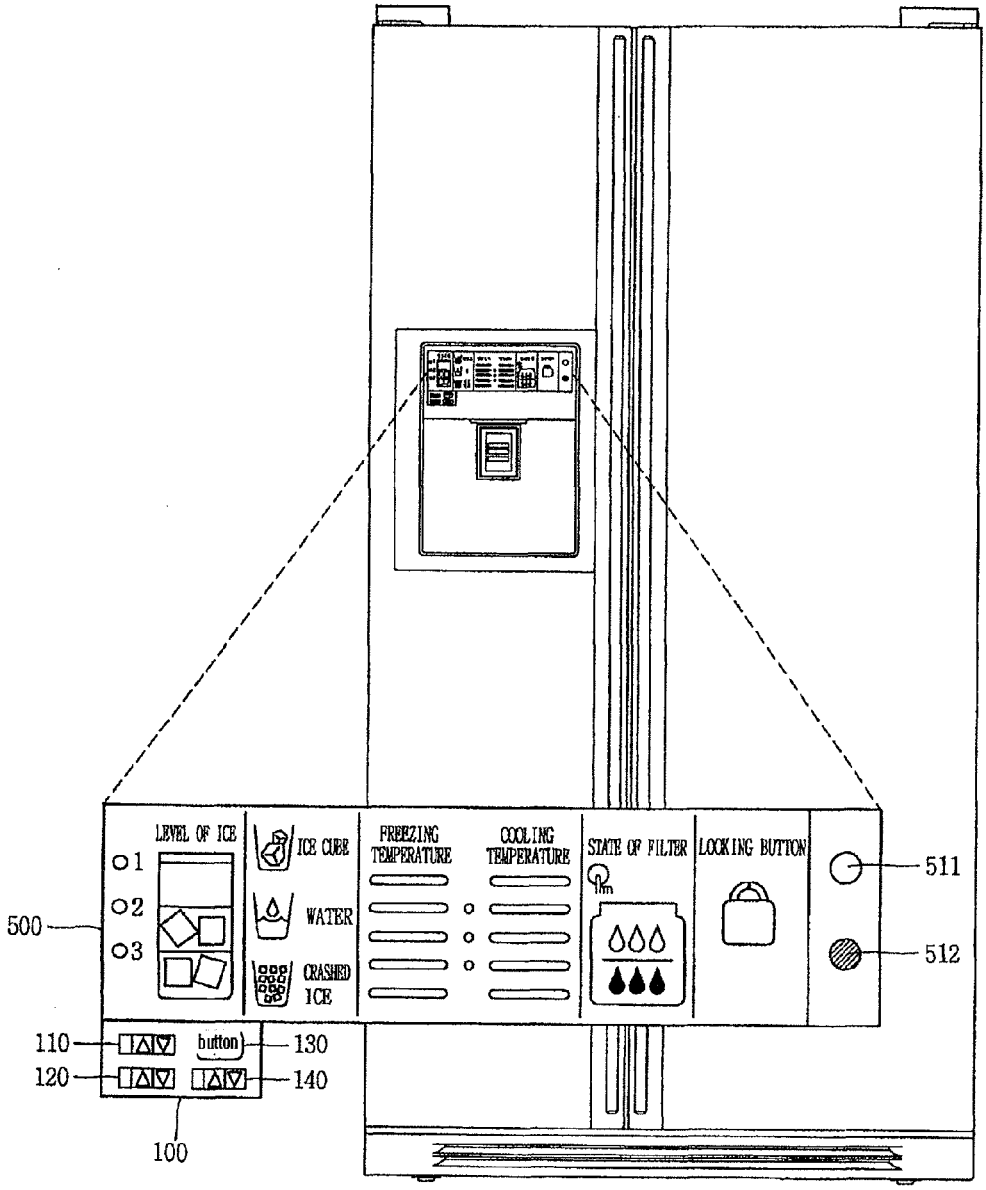
FIG. 2 is a front perspective view and a partially enlarged view showing the refrigerator of FIG. 1.

The input unit 100, as shown in FIG. 2, is disposed at one side of outer surface of a refrigerator body 1 together with the taking-out unit 200 and the display unit 500.

Further, the input unit 100 includes a taking-out amount setting button 110 for setting the amount of ice to be taken out by inputting of the user, and a taking-out time duration setting button 120 for setting the time duration by inputting of the user. Also, the input unit 100 further includes a setting completion button 130 for completing the setting of the amount and time duration for taking out the ice, which is inputted through the taking-out amount setting button 110 and the taking-out time duration setting button 120.

Further, the taking-out amount setting button 110 may be configured to be directly inputted by the user with respect to the amount of ice to be taken through a touch screen or a keypad.

Further, the taking-out amount setting button 110 may be implemented as an up/down button so as to increase or decrease the number of ice inputted whenever the up/down button is clicked.

Further, the input unit 100 may be further provided with an ice amount setting button 140 for setting the number of ice generated through the ice-making unit 300.

Further, the input unit 100 may further include a microphone (not shown) so that at least one information among the amount and/or time duration for taking out the ice, the setting completion and the number of ice to be generated is inputted by voice signals of the user.

Figure 3:
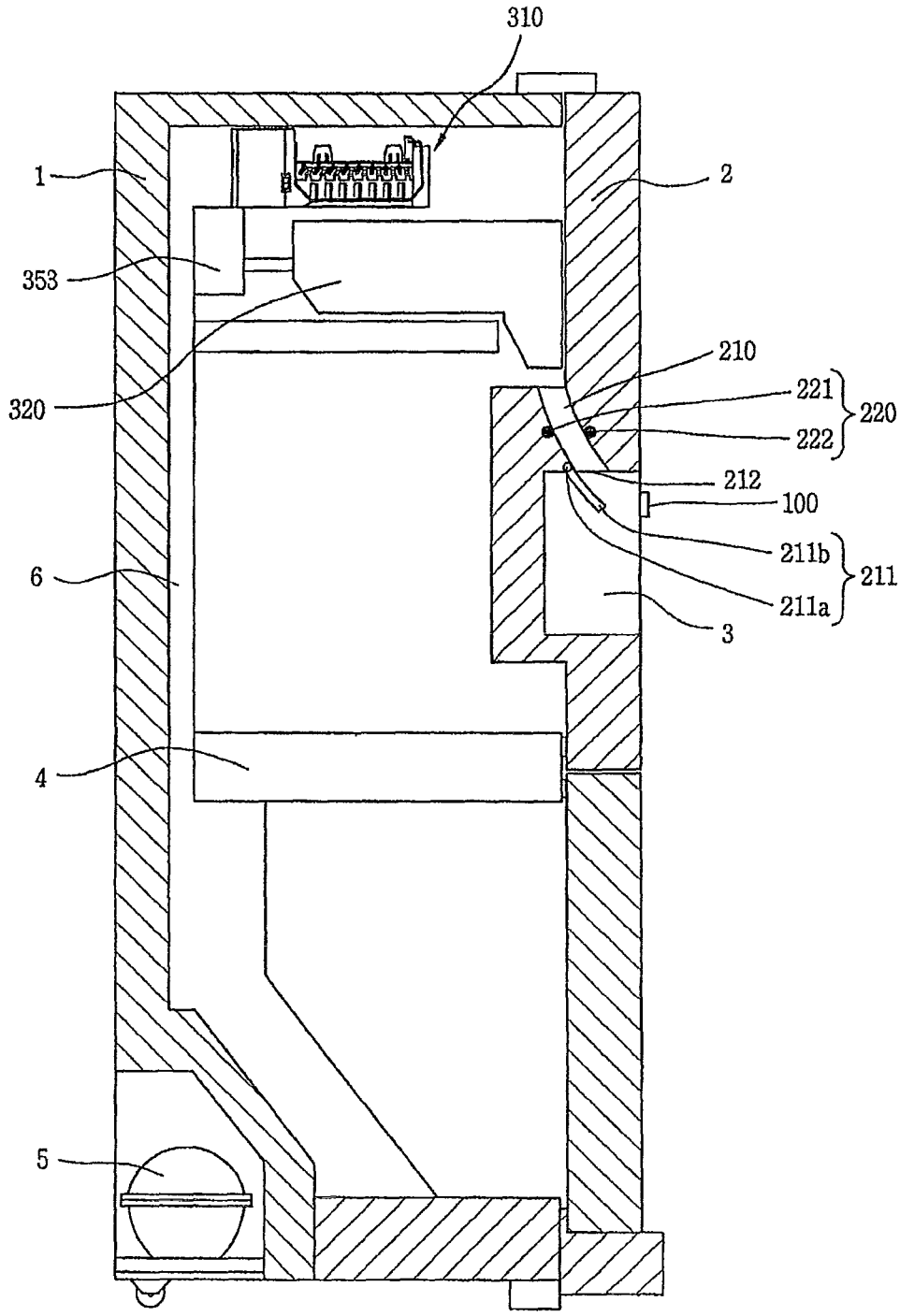
FIG. 3 is a lateral view showing the refrigerator having a taking-out unit in accordance with one embodiment of the present invention.

FIG. 3 is a diagram showing a cross section of the refrigerator including the taking-out unit 200.

As shown in FIG. 3, a freezing chamber and a cooling chamber are formed to be divided in a body 1 having an opened front surface. And, at least one door 2 is included so that the freezing chamber and the cooling chamber can be opened/closed. The door 2 is disposed at one side of the body 1 so that another end portion is rotatable toward a front/rear side of the body 1 with centering one end portion.

Further, a dispenser 3 for withdrawing the ice and/or water is included in one side of a front surface of the door 2. The dispenser 3 operates to take out the ice or/and water without opening the door 2. And, the dispenser 3 is formed resulting from an inwardly concaved portion of the front surface of the door 2.

The taking-out unit 200 is included in the freezing chamber and the door 2 so as to take out the ice according to the number.

Further, a shelf 4 for dividing into the freezing chamber and the cooling chamber is disposed in the freezing chamber and the cooling chamber. A freezing cycle including a compressor 5 is disposed at one side of the body 1. And, an inner wall of the body 1 is provided with an evaporator (not shown) and a cool air circulating passage 6 for supplying cool air cooled by passing through the evaporator to the freezing chamber or the cooling chamber.

Further, the taking-out unit 200 includes an output unit 210 for outputting the ice to a withdrawal opening 212 formed at the outer surface of the refrigerator body 1, and a sensing unit 220 for sensing the number of ice passing through the output unit 210.

The output unit 210 takes out the ice based on the amount and/or time duration for taking out, which is inputted through the input unit 100 by controlling of the control unit 600.

Further, the output unit 210 is formed to have a planar sectional area larger than the largest area of one piece of ice by a preset value so that the ice can be sequentially passed one by one.

Further, the output unit 210 may include an opening/closing unit 211 for controlling the output of the ice at a portion adjacent to the withdrawal opening 212.

The opening/closing unit 211 includes a solenoid 211*a* providing an opening/closing force, and a shutter 211*b* connected to the solenoid 211*a* so as to control the output of the ice by opening/closing the output unit 210 or to prevent heat transfer of interior/exterior of the freezing chamber.

Further, the opening/closing unit 211, the solenoid 211*a* and the shutter 211*b* are controlled by the control unit 600.

The sensing unit 220 is disposed on the wall of the output unit 210 so as to face each other, respectively, and includes a first light-emitting unit 221 emitting at least one light and a first light-receiving unit 222 sensing the light emitted from the first light-emitting unit 221. And, the sensing unit 220, the first light-emitting unit 221 and the first light-receiving unit 222 are controlled by controlling signals of the control unit 600. Also, preferably, the first light-emitting unit 221 and the first light-receiving unit 222 are formed with light emitting diodes, or they can be formed with various devices.

Further, preferably, the sensing unit 220 is disposed to be perpendicular to a direction for passing the ice at the output unit 210.

Further, the taking-out unit 200 is further provided with a counter (not shown) for counting the time duration so that the ice can be taken out according to the inputted time duration for taking out.

Figure 4:
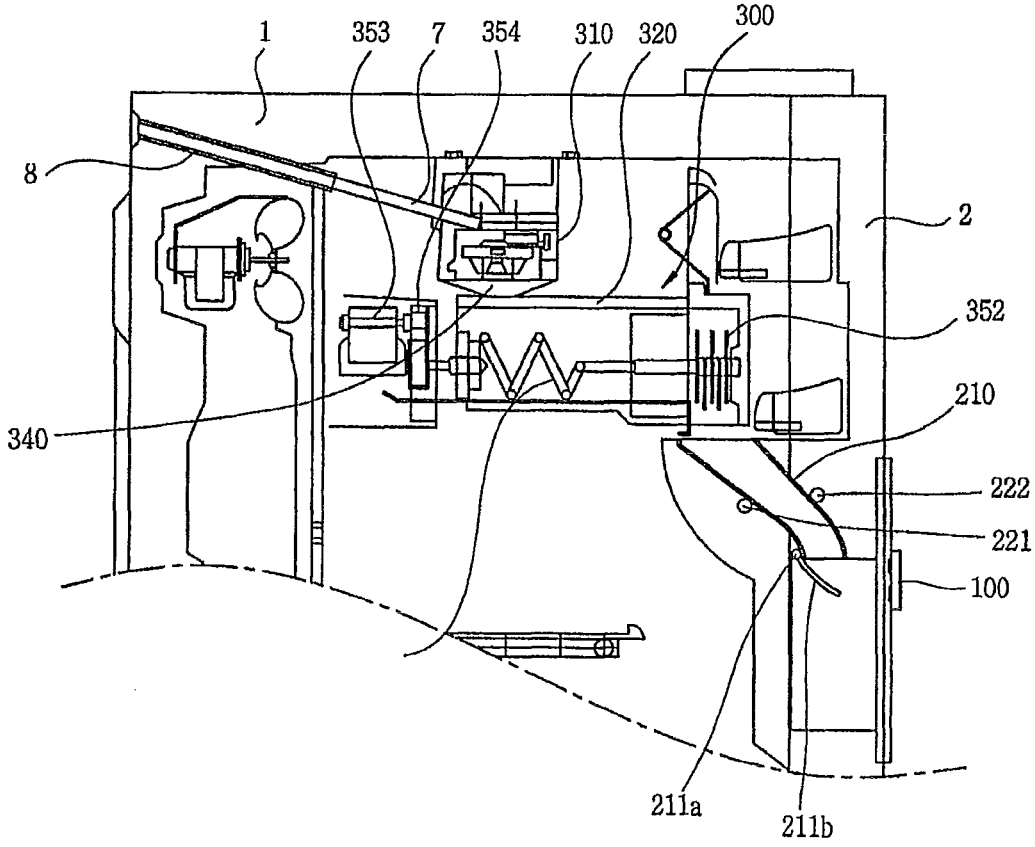
FIG. 4 is a lateral view showing the refrigerator having an ice-making unit in accordance with one embodiment of the present invention.

The ice-making unit 300, as shown in FIG. 4, includes an ice maker 310 for making ice from water by cool air and separating it, an ice storing unit 320 for storing the ice separated from the ice maker 310 and an ice amount detecting unit 330 for detecting the amount of ice stored in the ice storing unit 320.

A water supply pipe 7 is led in the upper portion of the body 1 so as to supply water for making ice to the ice maker 310. Also, a heater 8 is disposed at an outer circumferential surface of the water supply pipe 7. The heater 8 generates heat by a certain temperature so as to prevent the water supply pipe 7 from being frozen.

The ice maker 310 makes the ice by using water supplied from the water supply pipe 7, and the ice is separated to be transferred to the ice storing unit 320.

The ice storing unit 320 is located at a lower end of the ice maker 310, and an ice moving unit 340 is interposed between the ice maker 310 and the ice storing unit 320. The ice moving unit 340 transfers the ice separated from the ice maker 310 to the ice storing unit 320. Also, the ice moving unit 340 is formed to have the planar sectional area larger than the largest area of one piece of ice by a preset value so that the ice can be sequentially passed one by one.

The ice storing unit 320 stores the ice made in the ice maker 310.

Further, a screw 351 having a spiral shape is disposed in the ice storing unit 320. The screw 351 performs a function for transferring the ice stored in the ice storing unit 320 to the front side of the ice storing unit 320, that is to a shaving cutter 352 to be described below.

Further, a motor 353 is disposed at the rear side of the ice storing unit 320. The motor 353 provides a driving force for rotating the screw 351 and the shaving cutter 352. Also, a gearbox 354 is interposed between the rear surface of the ice storing unit 320 and the motor 353. And, a plurality of gears for increasing a driving torque by decreasing the driving force of the motor 353 are disposed in the gearbox 354. And, the driving speed and driving time duration of the motor 353 are controlled by controlling signals of the control unit 600.

Further, the shaving cutter 352 is disposed at the front side of the ice storing unit 320. The shaving cutter 352 crashes the transferred ice into pieces having a certain size by using the screw 351. The shaving cutter 352 crashes the ice into pieces having the certain size by being connected to the front end of the screw 351 and rotated by the driving force of the motor 353.

The ice crashed by the shaving cutter 352 is transferred to the dispenser 3 through the output unit 210.

Figure 5:
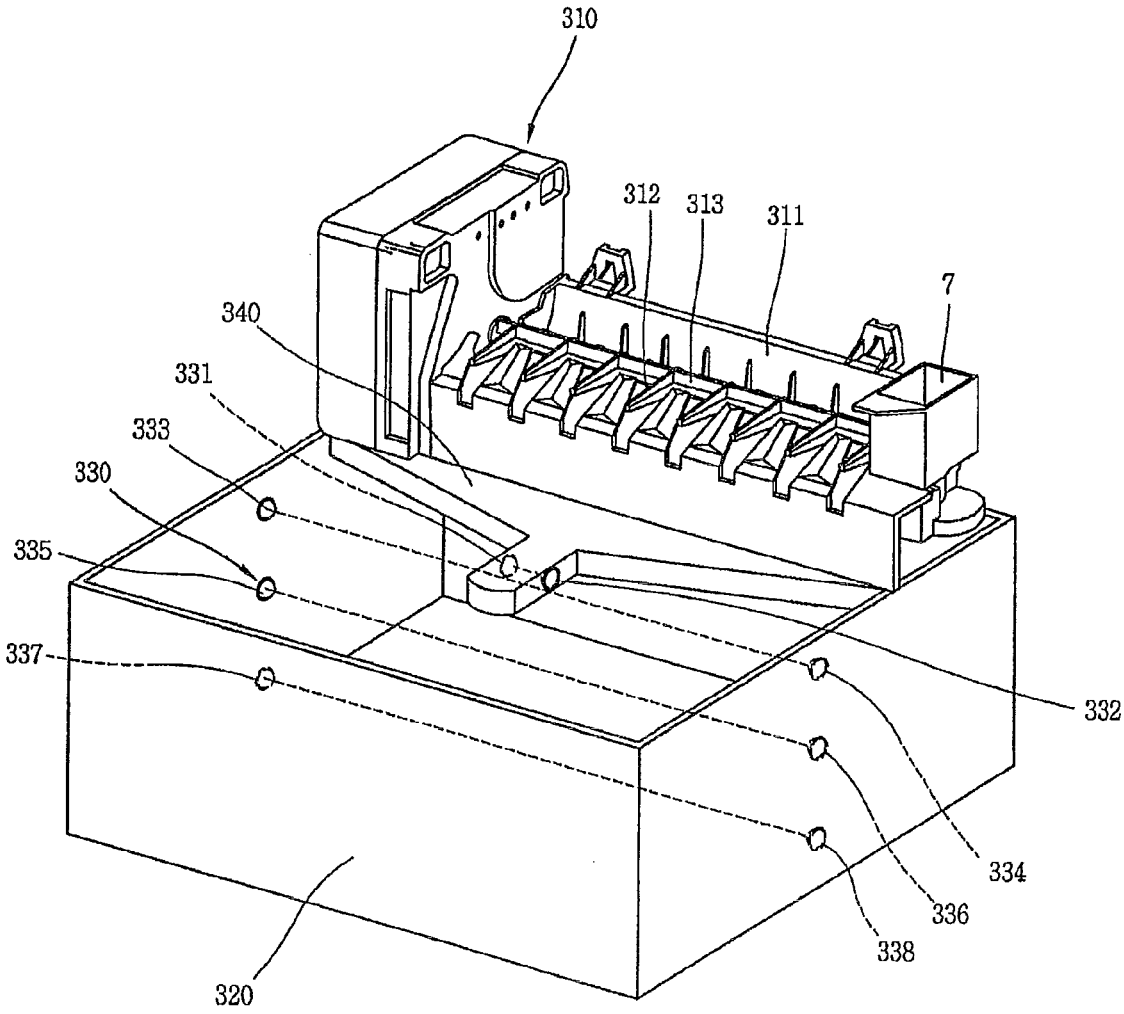
FIG. 5 is a partially enlarged view showing the ice-making unit in accordance with the present invention.

The ice amount detecting unit 330, as shown in FIG. 5, is provided with a plurality of light-emitting units 331, 333, 335, 337 and a plurality of light-receiving units 332, 334, 336, 338. And the number of ice that is stored in the ice storing unit 320 is detected through the plurality of light-emitting units 331, 333, 335, 337 and the plurality of light-receiving units 332, 334, 336, 338.

Namely, the ice maker 310 includes a ice making chamber 311 for generating the ice after receiving water through the water supply pipe 7, a motor (not shown) disposed in the other side of the ice making chamber 311 and an ejector 313 provided with a pin 312 for taking out the ice generated at the ice making chamber 311 to the ice storing unit 320 by being connected to the motor (not shown) and then rotated.

The ice taken out through the ejector 313 is stored in the ice storing unit 320 after passing through the ice moving unit 340.

The ice amount detecting unit 330 is disposed on the wall of the ice moving unit 340 to face each other, respectively, and includes a light-emitting unit 331 emitting light and a light-receiving unit 332 sensing the light emitted from the light-emitting unit 331. And, the ice amount detecting unit 330, the light-emitting unit 331 and the light-receiving unit 332 are controlled by controlling signals of the control unit 600.

Further, the ice amount detecting unit 330 may measure the amount of ice stored in the ice storing unit 320 by the plurality of light-emitting units 333, 335, 337 and the plurality of light-receiving units 334, 336, 338, which are disposed on the wall of the ice storing unit 320 to face each other, respectively.

The plurality of light-emitting units 333, 335, 337 and the plurality of light-receiving units 334, 336, 338 are configured to sensing the amount of ice stored in the ice storing unit 320 by three steps. That is, each pair comprised of the plurality light-emitting units 333, 335, 337 and the plurality of light-receiving units 334, 336, 338 is implemented as a first level sensor 333, 334, a second level sensor 335, 336, and a third level sensor 337, 338. And, the amount of ice stored in the ice storing unit 320 may be displayed for the user through the display unit 500, by signals sensed by the first, second and third level sensors.

Further, the ice amount detecting unit 330 may be implemented as more than three pairs of light-emitting units and the light-receiving units so as to classify the amount of ice stored in the ice storing unit 320 in more detail.

The state information storage unit 400 stores the amount and/or time duration for taking out the ice, which is inputted by the user.

Further, the state information storage unit 400 stores the amount of ice stored in the ice storing unit 320 by detecting through the ice amount detecting unit 330, or level information detected by the level sensors 333, 334, 335, 336, 337, 338.

Further, the state information storage unit 400 may store additional state information of the taking-out amount input unit 100, the taking-out unit 200, the ice-making unit 300, the display unit 400 and the control unit 600.

The display unit 500 displays the amount and/or time duration for taking out the ice, which is inputted by the user through the taking-out amount input unit 100.

Further, the display unit 500 provides the user with the state information through a display device such as a 7-segment, an LCD panel, or the like.

Further, the display unit 500 may display the number of the ice detected through the taking-out unit 200.

Further, the display unit 500 may display the number of the ice stored in the ice storing unit 320, or as shown in FIG. 2, display the amount of the ice approximately by classifying into levels.

Further, the display unit 500; as shown in FIG. 2, is configured to display the contents to be taken out, such as ice cube, water, crashed ice, etc., and the contents to be taken out can be selected by a non-shown additional input unit.

Further, the display unit 500 may be configured to display a freezing temperature, a cooling temperature, a state of a filter and a locking/releasing function.

Further, the display unit 500 further includes an alarming unit 510 for notifying the user whether or not the ice storing unit 320 is filled with the ice.

The alarming unit 510 may include a lamp 511 lighted when the ice storing unit 320 is filled with the ice.

Further, the alarming unit 510 may include an alarm generating unit 512 generating an alarm sound when the ice storing unit 320 is filled with the ice.

The control unit 600 takes out the ice, based on the amount and/or time duration for taking out the ice, which is inputted through the input unit 100.

Further, the control unit 600 compares the taking-out amount of the ice inputted through the input unit 100 with the number of the ice sensed through the sensing unit 220, and then controls for the ice to be taken out based on the comparison result. That is, the control unit 600 controls for the ice to be taken out through the output unit 210 by the number corresponding to the taking-out amount of the ice inputted through the input unit 100.

Further, the control unit 600, when the number of the ice sensed by the sensing unit 220 is less than the taking-out amount of the ice inputted through the input unit 100, controls the output unit 210 so that the ice can be additionally taken out.

Further, the control unit 600, when the number of the ice sensed by the sensing unit 220 is same as the taking-out amount of the ice inputted through the input unit 100, controls the output unit 210 so that the taking-out of the ice is stopped.

Further, the control unit 600, based on the time duration for taking out the ice inputted through the input unit 100, controls the taking-out unit 200 so that the ice can be taken out for the time duration corresponding to the time duration for taking out.

Further, the control unit 600 recognizes at least one voice inputted through the microphone (not shown) of the input unit 100, among the amount and/or time duration for taking out the ice, the setting completion and the number of the ice to be generated, and then performs the control corresponding to the recognized contents.

Further, the control unit 600 controls the ice-making unit 300 so as for the ice to be generated by the number inputted through the ice amount input button 140. And, when the ice storing unit 320 is filled with the ice, the control unit 600 controls the ice-making unit 300 so that the generation of the ice is stopped.

Further, the control unit 600 makes the ice through the ice maker 310 by the controlling signals of the control unit 600 and senses the amount of ice separated to be stored in the ice storing unit 320. And then, the sensed amount of ice is displayed through the display unit 500.

For example, when the user sets the amount of ice stored in the ice storing unit 320 by a second ice level of the display unit 500 through the ice amount input button 140, the ice maker 310 makes the ice until the second level sensors 335, 336 disposed at the ice amount detecting unit 330 sense the ice, and moves the separated ice into the ice storing unit 320. When the second level sensors 335, 36 sense the ice after the ice continuously piles up in the ice storing unit 320, the control unit 600 stops the operation of the ice maker 310 so as to stop separating the ice from the ice maker 310 to the ice storing unit 320. At the same time, the display unit 500 displays that the amount of ice stored in the ice storing unit 320 is in the second level, by the controlling signal of the control unit 600. Also, the display unit 500 may generate a voice signal indicating that the amount of ice stored in the ice storing unit 320 is in the second level by using the control unit 600 so that the generated voice signal is outputted to the user through the alarm generating unit 512 (as an example, a speaker). Accordingly, the user can make and store the ice as much as he/she wants.

Further, the control unit 600, while the ice corresponding to the amount and/or time duration for taking out, which is inputted through the input unit 100, is taken out through the taking-out unit 200, if all the ice stored in the ice storing unit 320 is taken out, controls the ice-making unit 200 so that the ice is generated. Also, the control unit 600 controls the taking-out unit 200 so that the generated ice is taken out, corresponding to the amount and/or time duration for taking out Further, the contents to betaken out can be water, or ice and water, as well as the ice. And, to take out the ice and/or water, the disclosed components can be partially modified.

Hereafter, in accordance with the present invention, a control method for taking out the ice of the refrigerator which is capable of taking out the ice, based on the amount for taking out, which is inputted by the user, will be described in detail with reference to FIGS. 1 to 5.

Figure 6:
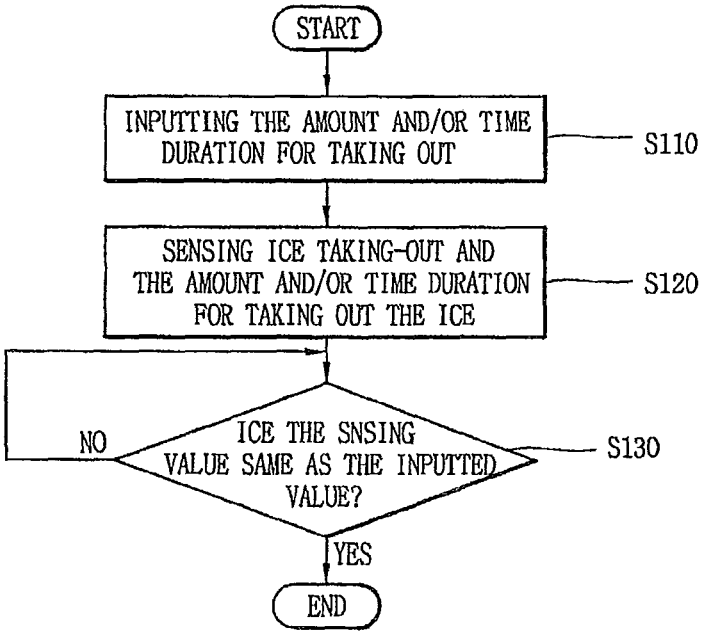
FIG. 6 is a flow chart showing a control method for taking out ice of a refrigerator in accordance with a first embodiment of the present invention.

FIG. 6 is a flow chart showing the control method for taking out the ice of the refrigerator in accordance with a first embodiment of the present invention.

First, the amount and/or time duration for taking out the ice is inputted by the user through the taking-out amount setting button 110 and the taking-out time duration setting button 120, and displayed through the display unit 500 (S110).

Hereafter, the ice corresponding to the inputted amount and/or time duration for taking out is taken out through the taking-out unit 200 by controlling of the control unit 600.

Here, the ice taken out through the taking-out unit 200 is outputted through the withdrawal opening 212 formed at the outer surface of the refrigerator. And, the sensing unit 220 is disposed at the right and left sides of the withdrawal opening 212 so that the number of outputted ice or the time duration for taking out the ice is counted. Also, the counted number of ice or time duration for outputting the ice is displayed through the display unit 500.

Further, during the taking-out of the ice, if there is no ice stored in the ice storing unit 320, the control unit 600 controls the ice-making unit 300 so that the ice is generated. Then, the control unit 600 controls the taking-out unit 200 to enable to output the ice corresponding to the inputted amount and/or time duration for taking out, and then outputs the generated ice (S120).

Hereafter, the counted number of ice or time duration for taking out the ice is compared with the inputted amount and/or time duration for taking out the ice (S130). And, until the counted number of ice or time duration for taking out the ice is same as the inputted amount and/or time duration for taking out the ice, the control unit 600 continuously outputs the ice by controlling the taking-out unit 200.

Figure 7:
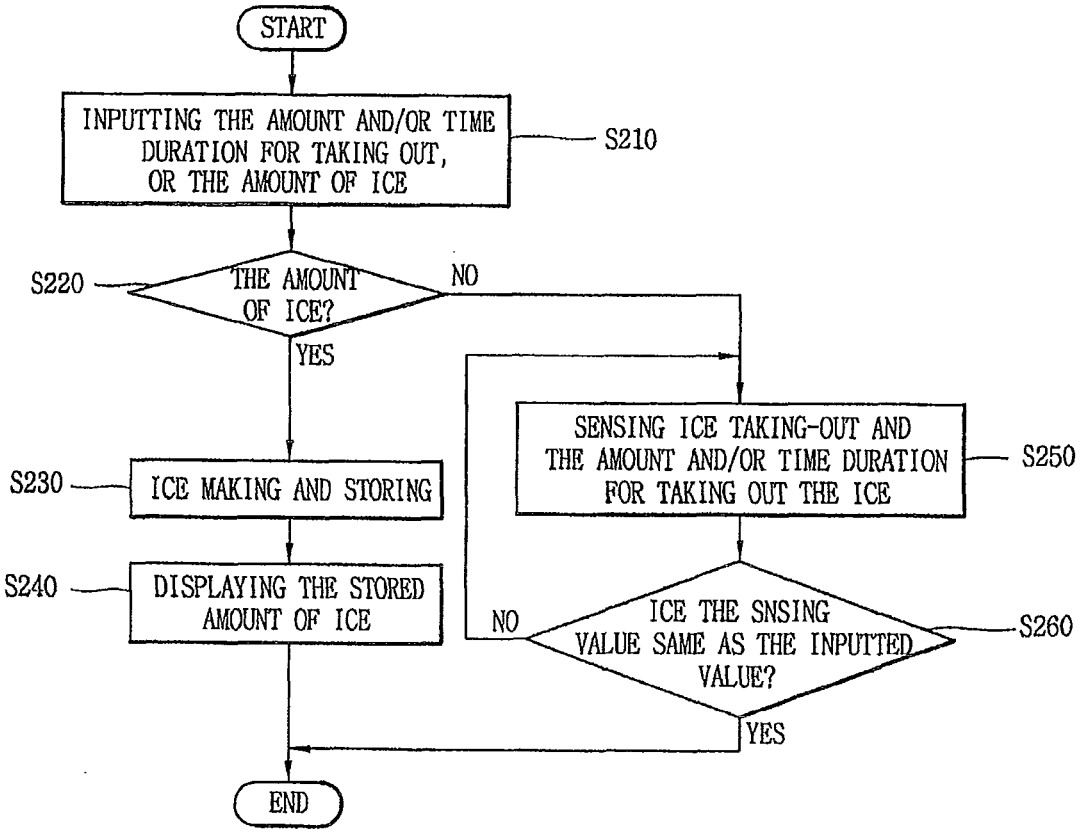
FIG. 7 is a flow chart showing a control method for taking out ice of a refrigerator in accordance with a second embodiment of the present invention.

FIG. 7 is a flow chart showing the control method for taking out the ice of the refrigerator in accordance with a second embodiment of the present invention.

First, the amount and/or time duration for taking out the ice is inputted through the taking-out amount setting button 110 and the taking-out time duration setting button 120, or the amount of ice to be stored is inputted through the ice amount setting button 140, by the user, and then the inputted amount and/or time duration for taking out the ice, or the amount of ice to be stored is displayed through the display unit 500 (S210).

Hereafter, it is determined that the inputted value corresponds to the amount of ice to be stored (S220). As a result of the determination, if the inputted value corresponds to the amount of ice to be stored, the ice is made and separated corresponding to the inputted amount so that the separated ice is stored in the ice storing unit 320.

Also, through the ice amount detecting unit 330, the amount of ice stored in the ice storing unit 320 is detected. And, the control unit 600 controls the ice-making unit 300 so that the ice is made and separated, until the detected amount of ice is same as the user-inputting amount of the ice to be stored (S230).

Hereafter, the number of ice stored in the ice storing unit 320 is displayed through the display unit 500.

Also, it is alarmed whether or not the ice storing unit 320 is filled with the ice by lighting up the lamp, or the alarm sound is generated to be outputted to the user through the alarm generating unit 512 (S240).

As a result of the determination, if the inputted value does not correspond to the amount of ice to be stored, the ice corresponding to the inputted amount and/or time duration for taking out is taken out through the taking-out unit 290 by controlling of the control unit 600. And then, the amount or time duration for taking out the ice is counted so that the step S120 displaying through the display unit 500 is performed.

Hereafter, the counted number of ice or time duration for outputting the ice is compared with the inputted amount and/or time duration for taking out the ice (S260). And then, the control unit 600 controls the taking-out unit 200 so that the ice is continuously outputted, until the counted number of ice or time duration for taking out the ice is same as the inputted amount and/or time duration for taking out the ice.

Figure 8:
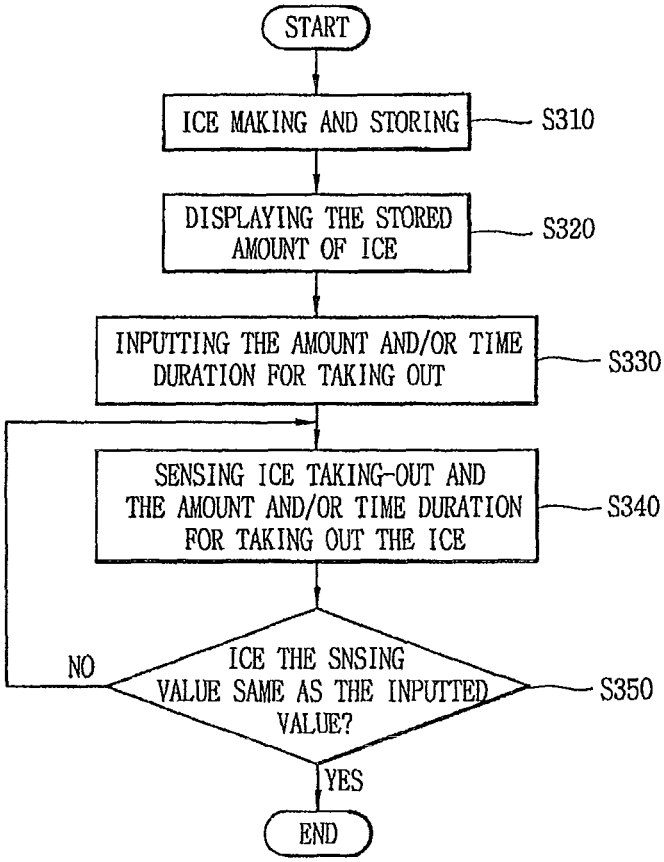
FIG. 8 is a flow chart showing a control method for taking out ice of a refrigerator in accordance with a third embodiment of the present invention.

FIG. 8 is a flow chart showing the control method for taking out the ice of the refrigerator in accordance with a third embodiment of the present invention.

First, the control unit 600, when the amount of ice stored in the ice storing unit 320 is less than a first standard amount preset by the user, controls the ice-making unit 300 so that the ice is made or separated by the second standard amount preset by the user, or when the number of ice to be stored is inputted by the user, the ice corresponding to the inputted number is made and separated, and then the separated ice is stored in the ice storing unit 320. Here, the second standard amount is same as the amount of the first standard amount or more (S310).

Hereafter, the amount or level of the ice stored in the ice storing unit 320 is sensed so that the sensed amount or level of the ice is displayed through the display unit 500.

Also, it may be alarmed whether or not the ice storing unit 320 is filled with the ice by lighting up the lamp, or the alarm sound may be generated to be outputted to the user through the alarm generating unit 512 (S320).

Hereafter, the ice corresponding to the amount and/or time duration for taking out, which is inputted through the input unit 100, is taken out through the taking-out unit 200 by controlling of the control unit 600. And then, the amount or time duration for taking out the ice is counted so that the step S120 displaying through the display unit 500 is performed.

Hereafter, the counted number of ice or time duration for outputting the ice is compared with the inputted amount and/or time duration for taking out the ice (S350). And then, the control unit 600 controls the taking-out unit 200 so that the ice is continuously outputted, until the counted number of ice or time duration for taking out the ice is same as the inputted amount and/or time duration for taking out the ice.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

Effect of the Invention

As aforementioned in detail, the present invention enables the user to make and store the ice as much as he/she wants, by taking out the ice corresponding to the amount and/or time duration for taking out, which is inputted by the user.

Further, the present invention enables to provide the user with convenience in use, by displaying whether or not the ice is full for the user when the ice storing unit is filled with the separated ice which is stored therein.

Further, the present invention enables to provide the user with convenience in use, by being configured to display the amount or level of the ice stored in the ice storing unit.

The invention claimed is:

1. A control apparatus for taking out ice of a refrigerator comprising:

an input unit for inputting the amount of ice to be taken out;

a taking-out unit for taking out the ice corresponding to the amount input to the input unit;

a display unit for displaying the amount of ice to be taken out, which is input through the input unit; and an ice-making unit for making and storing ice after receiving water, and for detecting the stored amount of ice, wherein the input unit comprises:

a taking-out amount setting button for setting the amount of ice to be taken out; and a taking-out time duration setting button for setting the time duration for taking out the ice, wherein the taking-out unit comprises:

an output unit for outputting the ice to a withdrawal opening formed at the outer surface of the refrigerator body; and a sensing unit for sensing the amount of ice passing through the output unit, and wherein the amount of ice to be taken out is input through the taking-out amount setting button by the user, and then the input amount and time duration for taking out the ice and the amount of ice taken out is displayed through the display unit, wherein the ice-making unit comprises:

an ice maker for making ice from water by cool air and separating the ice;

an ice storing unit for storing the ice separated from the ice maker; and an ice moving unit for moving the separated ice to the ice storing unit, wherein the ice moving unit comprises a pair of detecting sensors disposed on the wall of the ice moving unit to face each other, wherein the detecting sensors comprise a light-emitting unit and a light-receiving unit, and the detecting sensors count a number of separated ice which pass through the ice moving unit from the ice maker to the ice storing unit, and wherein the ice storing unit comprises a plurality of level sensors disposed on a wall of the ice storing unit to face each other, so as to transmit/receive infrared signals to each other, and the level sensors measure the amount of ice stored in the ice storing unit.

2. The apparatus of claim 1, further comprising a control unit for controlling the input unit and the taking-out unit.

3. The apparatus of claim 2, wherein the control unit compares the amount of the ice input to the input unit with the amount of ice sensed through the sensing unit, and then controls for the ice to be taken out based on the comparison result.

4. The apparatus of claim 1, wherein the output unit is formed to have a planar sectional area larger than the largest area of one piece of ice by a preset value so that the ice can be sequentially passed one by one.

5. The apparatus of claim 1, wherein the output unit further comprises an opening/closing unit for opening/closing the output of the ice at a portion adjacent to the withdrawal opening.

6. The apparatus of claim 1, wherein the plurality of level sensors comprises at least one first light-emitting unit and a second light-receiving unit disposed on a wall of the ice storing unit to face each other so as to transmit/receive infrared signals to each other.

7. The apparatus of claim 6, wherein the plurality of level sensors further comprises:

at least one second light-emitting unit and a second light-receiving unit disposed on a wall of the ice storing unit to face each other so as to transmit/receive infrared signals to each other.

8. The apparatus of claim 7, wherein the plurality of level sensors further comprises at least one third light-emitting unit and a third light-receiving unit disposed on a wall of the ice storing unit to face each other so as to transmit/receive infrared signals to each other.

9. The apparatus of claim 1, wherein the input unit further comprises an ice amount setting button for inputting the amount of ice so as to set the amount of ice stored in the ice storing unit.

10. The apparatus of claim 1, wherein the display unit displays the amount of ice detected through the ice amount detecting unit.

11. The apparatus of claim 1, wherein the display unit further comprises an alarming unit for providing whether or not the ice storing unit is filled with ice to a user.

12. The apparatus of claim 11, wherein the alarming unit is implemented as a lamp lighted when the ice storing unit is filled with ice.

13. The apparatus of claim 11, wherein the alarming unit is an alarm generating unit generating an alarm sound when the ice storing unit is filled with ice.

14. The apparatus of claim 1, wherein the control unit controls an operation of the ice-making unit according to the input amount of ice or whether or not the ice storing unit is filled with ice.

15. A control method for taking out ice of a refrigerator comprising:

making ice by a cool air after receiving water and separating the ice and storing the separated ice into an ice storing unit;

detecting the stored number or amount of the ice in the ice storing unit;

displaying the detected number or amount of the ice stored in the ice storing unit;

inputting an amount of ice to be taken out;

inputting a time duration for taking out the ice; and taking out the ice corresponding to the input amount, wherein the step of detecting the number of the ice stored in the ice storing unit is performed by counting the number of the separated ice which passes through an ice moving unit from an ice maker to the ice storing unit, using a pair of detecting sensors disposed on the wall of the ice moving unit to face each other, respectively, the pair of detecting sensors comprising a light-emitting unit and a light-receiving unit, wherein the step of detecting the amount of the ice stored in the ice storing unit is performed by measuring the level of the ice in the ice storing unit, using the plurality of level sensors disposed on a wall of the ice storing unit to face each other, respectively, so as to transmit/receive infrared signals to each other, and wherein the step of taking out the ice comprises:

outputting the ice to a withdrawal opening formed at an outer surface of the refrigerator;

detecting an amount of ice passing through the withdrawal opening; and comparing the input amount of ice for taking out with the detected amount of ice, and controlling an operation for taking out the ice based on the comparison result.

16. The method of claim 15, further comprising inputting the amount of ice from the user so as to determine the amount of ice to be stored.

17. The method of claim 15, further comprising displaying alarms indicating whether or not the ice is full in the ice storing unit.

18. The method of claim 17, wherein the step of displaying alarms comprises lighting a lamp indicating whether or not the ice is full.

19. The method of claim 17, wherein the step of displaying alarms comprises generating an alarm sound indicating whether or not the ice is full.

* * * * *